United States Patent [19]

Rossi et al.

[11] 4,163,129

[45] Jul. 31, 1979

[54] CONDITION RESPONSIVE CONTROL SWITCH UNITS

[75] Inventors: Guglielmo Rossi, Stutensee Friedrichstal, Fed. Rep. of Germany; Vincenzo Ferloni, Lurate, Italy

[73] Assignee: Ranco Incorporated, Columbus, Ohio

[21] Appl. No.: 794,721

[22] Filed: May 9, 1977

[51] Int. Cl.[2] ..... H01H 35/24

[52] U.S. Cl. ..... 200/81.4; 200/81 R; 200/83 Y; 200/83 P

[58] Field of Search ..... 200/81 R, 83 C, 83 D, 200/83 P, 83 R, 83 S, 83 SA, 83 Y, 81.4, 81.5; 337/117, 119, 120, 321

[56] References Cited

U.S. PATENT DOCUMENTS

| | | | |
|---|---|---|---|
| 3,177,321 | 4/1965 | Grimshaw | 337/321 |
| 3,272,942 | 9/1966 | Brandl | 337/120 |
| 3,274,360 | 9/1966 | Brandl | 337/120 |
| 3,412,357 | 11/1968 | Odashima | 337/321 |

*Primary Examiner*—Gerald P. Tolin

*Attorney, Agent, or Firm*—Watts, Hoffmann, Fisher & Heinke Co.

[57] ABSTRACT

A control switch unit adaptable for a number of different purposes has a fluid-filled flexible-walled capsule acting within a housing on a pivoted operating lever arranged to operate a switch located in the housing on the other side of the pivot axis of the lever from the capsule, the lever being biased by a cam-adjustable tensioning spring acting on the opposite side of the operating lever from the capsule and the switch. Further components such as a manual switch-off control, a pilot lamp operable by an auxiliary switch, or a capsule heater, can be added without rearrangement of the basic unit.

19 Claims, 10 Drawing Figures

CONDITION RESPONSIVE CONTROL SWITCH UNITS

BACKGROUND OF THE INVENTION

This invention relates to control switch units.

More particularly the invention concerns temperature or pressure responsive switch units in which a switching operation is effected in response to deformation of a fluid-filled flexible-walled capsule or power element.

A known type of such a control switch unit comprises a housing, a fluid-filled flexible-walled power element or capsule mounted within the housing, an operating lever pivotally mounted in the housing and arranged to operate a switch located in the housing in response to deformation of the capsule, a tension spring located within the housing and acting on the operating lever, the tension spring exerting a moment on the lever in opposition to that exerted thereon by the capsule, and cam means for adjusting the tension in the spring to predetermine the operating point of the switch in response to deformation of the capsule.

An object of the present invention is to provide a switch unit of the aforesaid type which is of simple construction and assembly while being versatile in its practical applications, and capable of adaptation to a variety of different uses without radical modification.

SUMMARY OF THE INVENTION

According to the present invention there is provided a control switch unit comprising:

a housing having a housing wall;

a fluid-filled power element mounted within the housing opposite said housing wall;

an operating lever pivotally mounted in the housing and cooperating with the power element;

a switch located in the housing and cooperating with the operating lever to be operated by the power element through the lever, both the power element and the switch being disposed on the same side of the operating lever and on opposite sides of the pivot axis of the lever;

a tension spring located within the housing and acting on the opposite side of the operating lever from the power element and the switch, said tension spring exerting a moment on the lever in opposition to the power element;

cam means acting upon the spring to adjust the tension thereof and to predetermine the operating point of the switch under control of the power element; and a settng shaft connected to the cam means for adjustment of the latter, said setting shaft being rotatable in said housing wall.

The arrangement of the switch unit with the cam setting shaft in the wall of the switch housing opposite the power element and the switch itself, with the operating lever pivoted between the power element and the switch, lends itself to easy assembly of the switch unit and moreover can, in preferred embodiments of the invention, leave adequate space within the housing for ancilliary switches or switch operating members, without the necessity to modify the basic components of the switch unit.

Preferably the axis of the setting shaft is perpendicular to the pivot axis of the operating lever.

In preferred practical embodiments of the invention the tension spring comprises a helical spring the longitudinal axis of which extends generally parallel to the operating lever, the spring being anchored at one end to a protuberance on the operating lever and at its other end to a slider which is movable in the direction of the longitudinal axis of the spring under control of the cam means.

The cam means permit fine adjustment of the tension in the spring and, therefore, the operating point of the switch, that is, the temperature (or pressure) sensed by the power element at which the switch is operated.

It will be understood that in the present context the term "power element" connotes any fluid-filled flexible-walled device, such as a bellows, capsule or diaphragm, which exhibits a deformation in response to changes in internal pressure, usually associated with temperature changes at a remote sensing point to which the device is connected through a capillary tube. The control switch unit according to the invention would not necessarily be employed for sensing temperature in this way: the switch unit could for example be employed as a pressure responsive switch, in which case the pressure to which the switch unit responds would be the fluid pressure within the power element.

To permit adjustment of the setting range of the cam means the tension spring preferably has a screw-adjustable anchorage to the cam-operated slider by means of which the tension in the spring can be adjusted independently of the adjustment thereof by the cam means.

The operating lever may comprise a plate which is pivotally supported in opposite walls of the housing by lugs on the plate intermediate the points of engagement of the lever with the power element and the switch.

The switch in preferred embodiments of the invention comprises an electrically insulating base attached to the housing and supporting a fixed switch contact and a snap-action switch blade carrying a switch contact movable relative to the fixed contact, the switch blade being engageable by the operating lever to effect snap-separation and/or snap-closure of the switch contacts. Suitable snap-action switch blades for this purpose are described in U.S. patent application Ser. No. 632,006 filed Nov. 14, 1975, now abandoned, and Ser. No. 668,289 filed Mar. 18, 1976.

Preferably the separation of the switch contact in the open condition of the switch is adjustable by means of an adjustment screw accessible from the outside of the housing. This so-called "differential" adjustment screw would serve to adjust the temperature range (or pressure range in the case of a pressure responsive switch) between the opening and the closing of the switch contacts. In a preferred practical arrangement the snap-action switch blade has a fixed mounting on the insulating base and projects cantilever-fashion from its fixed mounting in a direction generally parallel to the pivot axis of the operating lever.

The switch unit according to the invention may be adapted to perform more than one switching operation. For example, in a preferred embodiment, in which the cam means comprises a cam disc located within the housing and attached to a rotatable cam setting shaft projecting from the housing an auxiliary cam may be mounted on the same shaft as the cam disc, this auxiliary cam acting through a cam following lever mechanism on an auxliary switch within the housing connected in series with the first switch. This auxiliary switch would normally be carried on the same insulating base as the first switch. The lever mechanism cooperating with the auxiliary cam may, for example, comprise a bell-crank lever one arm of which is engageable by the auxiliary cam and the other arm of which has a hinge connection to a plunger which is displaceable longitudinally within the housing for engagement with an operating part of the auxiliary switch. Preferably both the bell-crank lever and the plunger are formed of plastics material, the hinge connection between the bell-crank lever and the plunger consisting of an integral flexible portion of the said plastics material.

For some practical applications it may not be necessary to provide an externally adjustable cam arrangement for controlling the operating point of the switch, in which case the cam means may be dispensed with. A temperature or pressure responsive switch unit according to such an alternative embodiment of the invention comprises a housing containing a fluid-filled flexible-walled capsule secured to a wall of the housing, an operating lever pivotally mounted in the housing and arranged to operate a switch located in the housing in response to deformation of the capsule, the capsule and the switch being disposed on the same side of the operating lever, a helical tension spring acting upon the operating lever and extending generally parallel to the lever on the opposite side thereof from the capsule and the switch, and an adjustable anchorage for the end of the tension spring remote from the operating lever, said adjustable anchorage being connected to or abutting an external wall of the housing and being adjustable from the outside of the housing, the operating lever being pivotally supported in opposite walls of the housing for rocking movement about a transverse pivot axis perpendicular to the longitudinal axis of the helical tension spring.

A further lever may be pivotally mounted in the housing and engageable by the switch operating lever in one direction of rocking movement only of the latter, the further lever being biased by a spring of adjustable tension. The biasing spring acting on this further lever may have an anchorage at its end remote from the further lever which is adjustable by a cam to predetermine the force which the further lever exerts on the switch operating lever when engaged by the latter.

BRIEF DESCRIPTION OF THE DRAWINGS

The invention will now be further described, by way of example, with reference to the accompanying purely diagrammatic drawings, in which.

DETAILED DESCRIPTION OF THE ILLUSTRATED EMBODIMENTS

Figure 1:
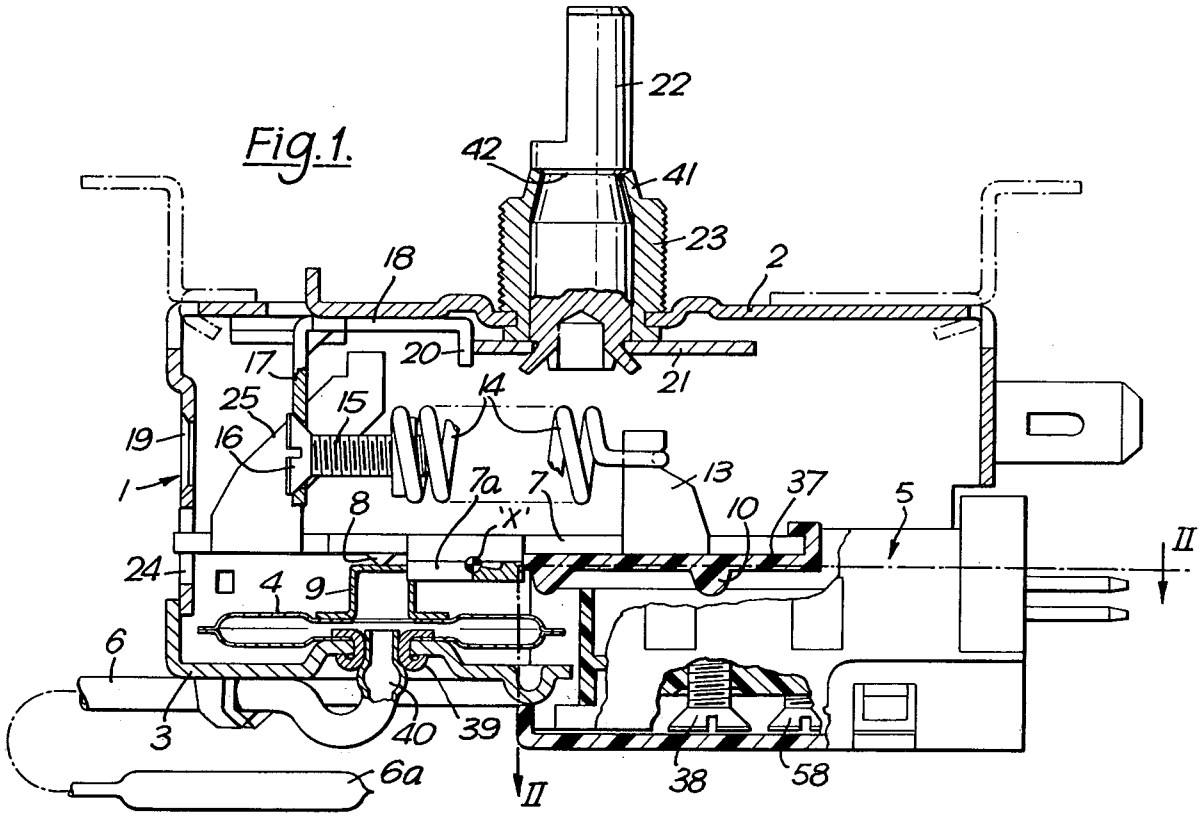
FIG. 1 is a cross sectional view of a temperature responsive control switch unit according to one embodiment of the invention.

The basic control switch unit illustrated in FIG. 1 comprises a housing 1 formed by a pressed sheet metal frame 2 of U-shaped cross sectional form partially closed on its open side by a pressed sheet metal support plate 3. A power element comprising a flexible-walled fluid-filled capsule 4 is secured to the support plate 3 and a switch assembly 5 is secured to the housing frame 2 and adjoins the support plate 3 to complete the closure of the open side of the frame 2. The switch assembly 5 will be described in further detail later with reference to FIGS. 2 and 3.

Figure 3:
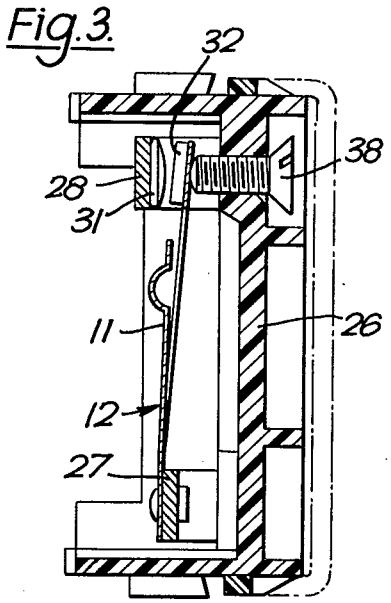
FIG. 3 is a cross section of the switch, taken on line III—III of FIG. 2.
Figure 2:
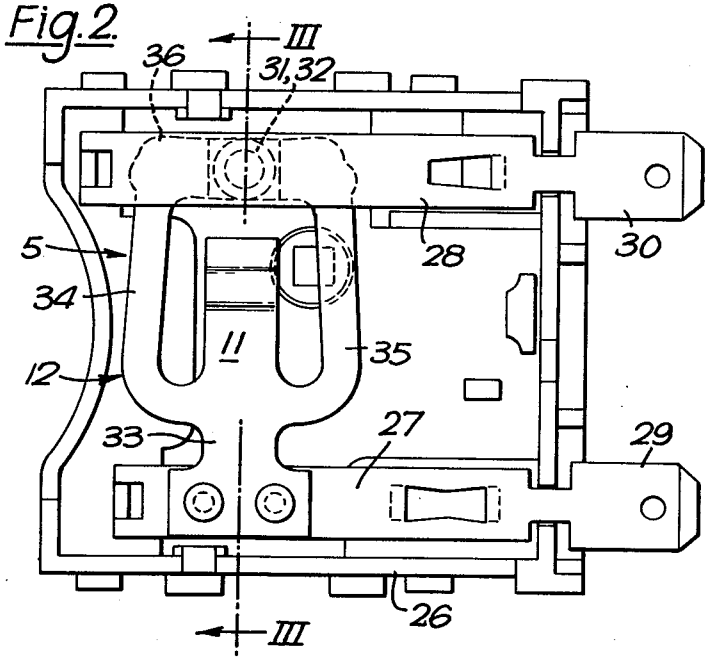
FIG. 2 is a partial section taken on line II—II of FIG. 1 illustrating the switch employed in the switch unit of FIG. 1.

The switch unit of FIGS. 1 to 3 is a temperature-responsive unit. The capsule 4 comprises a vapour-filled bellows device formed by two flexible resilient sheet metal walls welded together along adjoining edges to form a sealed capsule which communicates through a capillary tube 6 with a temperature sensing bulb 6*a* located at a point at which temperature is to be sensed, the bulb, the capillary tube 6 and the capsule 4 forming a sealed fluid-filled system the pressure in which is directly dependent upon the temperature of the bulb. The walls of the capsule 4 deform in response to changes in the internal pressure and, therefore, in the temperature sensed at the bulb 6*a*. This deformation is transmitted to a switching operating lever 7 comprising a rigid metal plate pivotally supported in the frame 1 for rocking movement about a transverse axis X.

The plate constituting the switch operating lever 7 is not shown in the interests of clarity in FIG. 2. The plate has laterally projecting lugs 7*a* which engage in apertures in the side walls of the frame 2 to define the pivot axis X of the lever 7.

On one side of the pivot axis X the lever 7 is formed with a nose 8 which engages a boss 9 welded to the central part of the capsule 4 and reinforcing the latter so that deformation of the capsule walls takes place in the region between the reinforcing boss 9 and the outer periphery of the capsule. On the other side of the pivot axis X the lever 7 is formed with a protuberance 10, on the same face of the lever plate as the nose 8, which is engageable with an operating tongue 11 (FIGS. 2 and 3) of a cantilever-mounted snap-action switch blade 12 forming part of the switch assembly 5.

On the opposite face of the lever plate from the protuberance 10, and on the same side of the pivot axis X, the lever 7 is provided with an upstanding lug 13 which provides an anchorage for one end of a helical tension spring 14, the opposite end of which is anchored to a nut carried by a presetting screw 15. The presetting screw 15 and has a head 16 which is located in an aperture in a bracket portion 17 of a cam slider 18, the head 16 of the screw 15 being accessible for adjustment purposes through an aperture 19 in an end wall of the housing 1. By adjusting the setting of the screw 15 the tension in the spring 14 is adjustable thereby regulating the biasing moment exerted on the switch operating lever 7, in an anti-clockwise direction as viewed in FIG. 1, and in turn controlling the force with which the lever 7 reacts against the capsule 4 through the boss 9.

The cam slider 18 is displaceable linearly along a base wall of the frame 2 and has an end flange 20 which is maintained by the tension spring 14 in engagement with the outer edge of a disc-like cam 21. The cam 21 is attached to a cam setting shaft 22 which is rotatable in a bush 23 secured in the base wall of the housing frame 2, the shaft 22 projecting outwardly from the housing 1. The axis of rotation of the shaft 22 is perpendicular to the transverse pivot axis X of the switch operating lever 7 and also generally perpendicular to the longitudinal axis of the helical tension spring 14.

The end of the lever 7 remote from the switch assembly 5 is located in a slot 24 in an end wall of the housing 1 to define the limits of pivotal movement of the lever 7 about the axis X—X. Adjacent this end the lever 7 is formed with an upstanding appendix 25 which, as will be evident from FIG. 1, lies in the path of movement of the flange 20 of the cam slider 18 as the latter is displaced upon rotation of the cam 21 by the shaft 22, so that upon rotation of the shaft 22 to one angular setting the flange 20 engages the appendix 25, further rotation of the shaft 22 causing the lever 5 to rotate about its pivot axis X to operate the switch 5 directly.

The switch assembly 5 which forms part of the switch unit is self-contained and is assembled separately and fitted to the switch housing 1. The switch assembly 5 is shown in FIGS. 2 and 3 and includes an insulating base 26 moulded in plastics material. Two conductors 27, 28 are secured to the base 26 and terminate in respective quick-connect terminals 29, 30 which project beyond the base 26. A fixed switch contact 31 (FIG. 3) is carried by the conductor 28 and cooperate with a movable switch contact 32 carried by the snap-action switch blade 12.

The snap-action switch blade 12 has an integral outwardly projecting tongue 33 by means of which the blade 12 is attached cantilever-fashion to the conductor 27 and thus to the base 26, the blade 12 extending generally parallel to the base 26 and to the pivot axis X of the lever 7.

The switch blade 12 has two arms 34, 35 which are drawn together by crimping of an integral bridge portion 36 interconnecting the two arms remote from the tongue 33, thereby pre-stressing the blade so that it adopts a dished deformation in the vicinity of the base of the two arms 34, 35 adjoining the tongues 11, 33. As a result of this pre-stressing of the blade 12 the arms 34, 35 will have a first stable position in which the blade is dished in one sense and the arms 34, 35 are both disposed on one side of the central tongue 11, and a second stable position in which the blade is dished in the opposite sense and the arms 34, 35 are disposed on the opposite side of the central tongue 11. The intermediate position in which the arms 34, 35 are coplanar with the central tongue 11 is inherently unstable, so that the blade will undergo snap-deformaton between the two stable positions.

The movable contact 32 is carried at the centre of the bridge portion 36 and is so arranged relative to the fixed contact 31 that upon snap-deformation of the blade 12 the contact 32 makes a snap movement relative to the fixed contact 31, either in a switch opening or switch closing sense.

In an alternative construction of the switch blade 12 the bridge portion 36 is constituted by the contact 32 itself, which may comprise a rectangular plate welded to the two arms 34, 35 in such a way as to draw these arms together and prestress the blade.

In the illustrated embodiment of the invention the switch blade 12 is itself conductive and carries current between the two conductors 27, 28 when the switch is closed. In view of this, the switch operating lever 7 is provided with an insulating part 37 formed with the switch operating protuberance 10, so that the switch operating lever and the associated mechanical parts of the unit are electrically insulated from the current carrying parts of the switch assembly 5.

In this example the switch assembly 5 is of the normally open type and the switch operating lever 7 acts through the protuberance 10 on the switch operating tongue 11, displacing the latter towards the base 26 of the switch (FIG. 3) until a point of instability is reached when the switch blade 12 snaps towards its other stable position, bringing the contact 32 into engagement with the fixed contact 31. The position of the contact 31 is such that the switch blade 12 does not reach its other stable position, and in consequence the central operating tongue 11 of the switch blade remains biased towards the operating lever 7. Upon release of the force applied to the tongue 11 by the operating lever 7, therefore, the tongue 11 moves progressively away from the base 26 as the lever 7 rocks anti-clockwise (as viewed in FIG. 1) until the point of instability of the blade 12 is again reached, when snap movement of the blade again occurs, removing the contact 32 from engagement with the fixed contact 31 towards its other position of stability. In moving towards this other stable position the contact 32 is arrested by a stop constituted by a screw 38 which is located in the base 26 of the switch. Adjustment of the screw 38 adjusts the gap between the switch contacts 31, 32 in the open condition of the switch, and the force with which the movable contact 32 abuts the screw 38. This in turn adjusts the temperature differential, as sensed at the bulb **6*a* connected to the capillary tube 6. between the point at which the switch closes and the point at which the switch subsequently opens. For this reason the screw 38** will be referred to as the "differential adjustment" screw.

By adjusting the angular setting of the cam setting shaft 22 the tension of the biasing spring 14 is adjusted, through the displacement of the cam slider 18 by the cam 21, and this in turn will adjust the biasing force exerted by the lever 7 on the capsule 4. For each angular setting of the shaft 22, therefore, there will correspond a different switch operating point, so that, a different internal pressure in the capsule 4 and, therefore, a different temperature sensed at the bulb **6*a*, will be necessary to operate the switch for each different cam setting. By adjusting the presetting screw 15 at a given setting of the cam shaft 22 it can be arranged that at a given setting of the cam shaft the switch is operated when a desired temperature (or pressure) is sensed by the capsule 4. Manual rotation of the cam shaft 22** from this setting will select the temperature (or pressure) at which the switch is operated.

As described and illustrated with reference to FIGS. 1 to 3 the switch unit is particularly applicable to the control of, for example, a refrigerator, in which it is desired to close the switch 5, and thereby energise the compressor motor of the refrigerator, when the temperature sensed by the capsule 4 rises to a predetermined level, and thereafter to open the switch 5, cutting off the motor, when the temperature as sensed by the capsule 4 has fallen to a second, lower level. The switch unit will operate to maintain the monitored temperature between the two levels. For this application the cam shaft will carry a manual operating element such as a knob rotatable between "warm" and "cold" settings to determine different operating points for the switch. In addition the cam shaft 22 will usually have an "off" setting in which the flange 20 of the cam slider 18 is engaged with the appendix 25 of the switch operating lever 7, as previously described, and has rotated the latter anti-clockwise about its pivot axis x (as viewed in FIG. 1) sufficiently to open the switch 5.

In the construction of the switch unit illustrated in FIGS. 1 to 3 the capsule 4 is attached to the support plate 3 by riveting or upsetting a cylindrical collar 39 welded to one of the flexible plates of the capsule 4, as illustrated in FIG. 1, the capsule 4 being held in position by the abutment of a bulbous portion 40 of the capillary tube 6 against the deformed collar 39.

The cam 21 is riveted onto the internal end of the cam shaft 22. The shaft 22 itself is located in the housing 1 by the bush 23 which has an outer peripheral lip 41 which, after assembly of the shaft 22 and the cam 21 is deformed inwardly to abut shoulder 42 formed on the shaft 22.

The switch unit illustrated in FIGS. 1 to 3 is a basic unit which can be modified to provide a "family" of different switch units for performing a number of ancillary switching functions by the addition of further components, and with minimal modification of the components of the basic switch unit.

Figure 4:
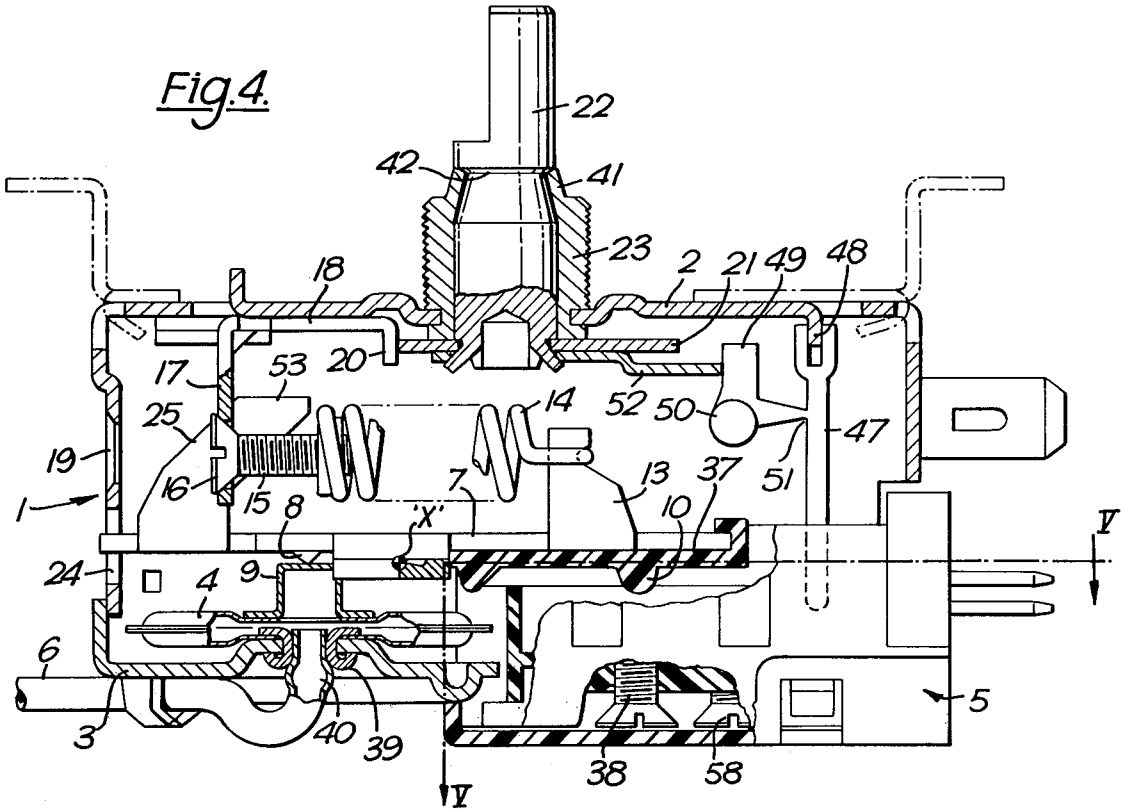
FIG. 4 is a sectional view corresponding to FIG. 1 of a modified version of the switch unit shown in FIG. 1.
Figure 6:
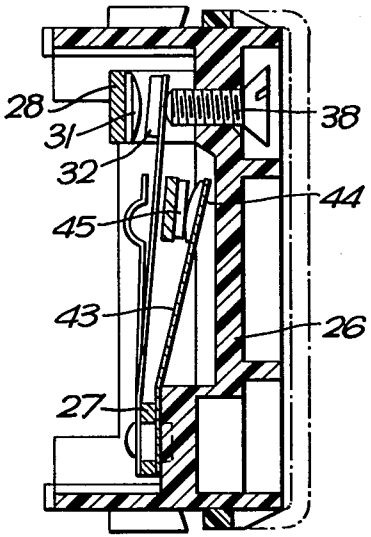
FIG. 6 is a cross section of the modified switch, taken on line VI—VI of FIG. 5.
Figure 5:
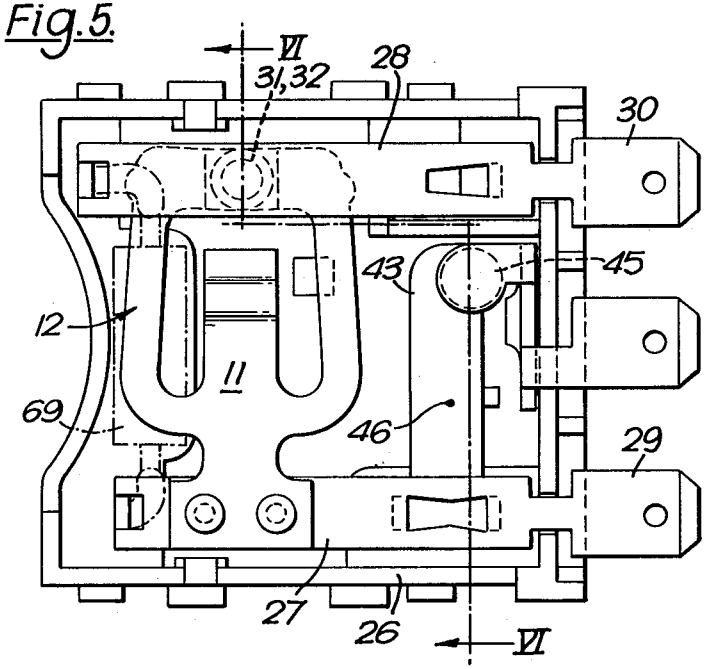
FIG. 5 is a sectional view, corresponding to FIG. 3, of a modified switch employed in the switch unit of FIG. 4.

FIGS. 4 to 6 illustrate the modification of the basic switch unit to provide an additional switch, incorporated in the switch assembly 5, which is connected electrically in series with the switch contacts 31, 32 of the main switch and serves as an auxiliary or "ON/-OFF" switch.

In the embodiment of FIGS. 4 to 6 the auxiliary switch comprises a resilient spring blade 43 carrying a switch contact 44 which normally engages a fixed contact 45. A point 46 on the switch blade 43 is engageable by a plunger 47 located within the housing 1 and guided for longitudinal displacement by a tab 48 projecting from and integral with the frame 2. The pluner 47 has a hinge connection to a bell-crank lever 49 pivotally mounted within the housing 1 on a transverse shaft 50. Both the bell-crank lever 49 and the plunger 47 are made of thermoplastics material and are connected integrally to each other by a thin ligament 51 which constitutes the hinge connection between the plunger 47 and the lever 49. The arm of the bell-crank lever 49 which is not connected to the plunger 47 is engaged by an auxiliary cam 52 carried by the same cam shaft 22 as the cam 21.

The arrangement is such that when the cam shaft 22 is rotated into an "OFF" setting the auxiliary cam 52 rocks the bell-crank lever 49 in a clockwise direction as viewed in FIG. 4, depressing the plunger 47 sufficiently to displace the spring blade 43 of the auxiliary switch, separating the contacts 44, 45 of the latter.

Since the embodiment of FIGS. 4 to 6 employs a separate series switch to perform the "OFF" function the raised appendix 25 of the switch operating lever 7 is truncated at 53 so that it is not engaged by either of the cams 21, 52.

Figure 8:
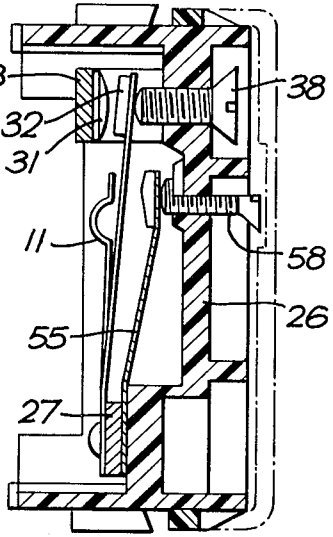
FIG. 8 is a cross-sectional view corresponding to FIG. 3, taken on the line VIII of FIG. 7
Figure 7:
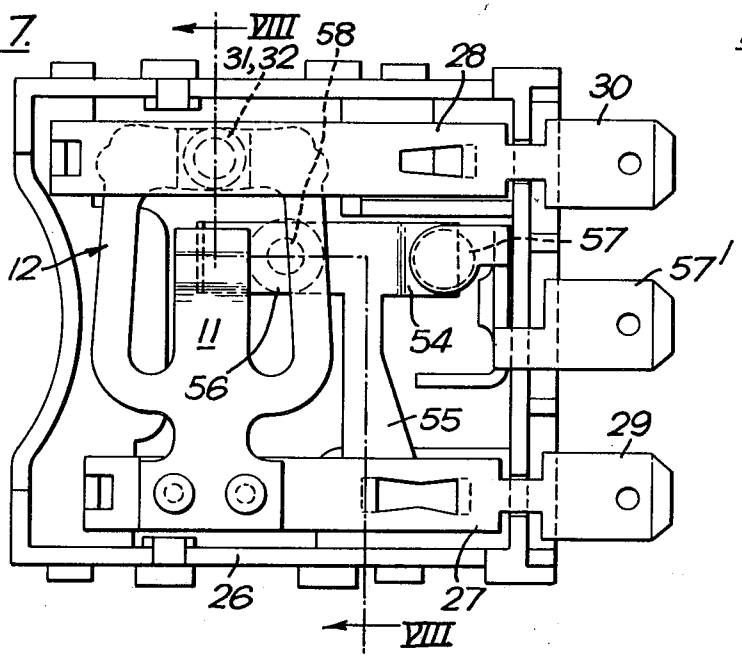
FIG. 7 is a cross sectional view corresponding to FIG. 2 of a switch employed in a switch unit according to a further embodiment of the invention.

In both the embodiments described with reference to FIGS. 1 to 3 and FIGS. 4 to 6 the switch assembly 5 may include an auxiliary signal switch mounted on the same base 26 as the main switch 5. A modification of the switch assembly shown in FIGS. 2 and 3 to include an auxiliary signal switch is shown diagrammatically in FIGS. 7 and 8. The auxiliary signal switch includes a movable contact 54 carried by a cantilever spring 55 which is formed with a lateral arm 56 located beneath the central operating tongue 11 of the main switch blade 12 (FIG. 7). The auxiliary switch has a fixed contact 57 connected to an auxiliary switch terminal 57'. The fixed contact 57 will be disposed either above or below the movable contact 54, as viewed in FIG. 7, according to whether the auxiliary switch is to be normally open or normally closed respectively. As illustrated the auxiliary switch is normally open.

When the central tongue 11 of the switch blade 12 is depressed by the action of the switch operating lever 7 the tongue 11 engages the arm 56, causing the latter to pivot about a fulcrum provided by an adjustment screw 58 screwed into the base 26 and thereby causing the movable contact 54 to move into engagement with the fixed contact 57. The contacts 54, 57 of the auxiliary signal switch can be used to monitor the operation of the main switch in the event of an abnormal increase in temperature, outside the normal range of operation of the main switch, the temperature at which the auxiliary switch operates being determined by the setting of the adjustment screw 58.

A typical example of the operation of the auxiliary signal switch would be in a refrigerator in which the compressor has ceased to function or is functioning incorrectly, while the thermostatic control of the main switch is still operating correctly, so that the contacts 31 and 32 are closed. Since the compressor is not functioning the sensed temperature will increase, and the tongue 11 will be depressed sufficiently to engage the arm 56 and operate the auxiliary switch.

If the auxiliary switch contacts 54 and 57 are normally open and connected to a circuit including a pilot lamp, the lamp will be lit when the auxiliary signal switch is operated. Alternatively, if the auxiliary switch contacts 54 and 57 are normally closed the associated circuit will be open when the auxiliary signal switch is operated.

The switch units hitherto described are suitable for the control of refrigerators, in which the cyclic operation of the compressor motor is controlled automatically to maintain the evaporator of the refrigerator within a predetermined temperature range. For some simple applications of the control switch the cyclic temperature variation is effected between fixed predetermined limits, and in this case the temperature selection cam 21 and its associated shaft 22 can be omitted, the anchoring screw 15 for the tensioning spring 14 being engaged directly with the frame 2 of the switch unit.

In refrigerators of the "two door" type having a freezer and a fresh food compartment with two different evaporators it is common to arrange for each cycle of operation of the compressor to be followed by an automatic defrost cycle of the evaporator located in the fresh food compartment, while the evaporator of the freezer compartment remains in operation. For this purpose the associated control switch must have a "cut-in" (that is, switch closing) temperature above freezing and a "cut-out" (that is, switch opening) temperature sufficiently low to ensure a suitable temperature in the freezer compartment for conservation of frozen food. The "cut-out" temperature should be capable of selection within limits, while the "cut-in" temperature should always remain constant, and above freezing, to ensure the completion of each defrosting cycle.

Figure 9:
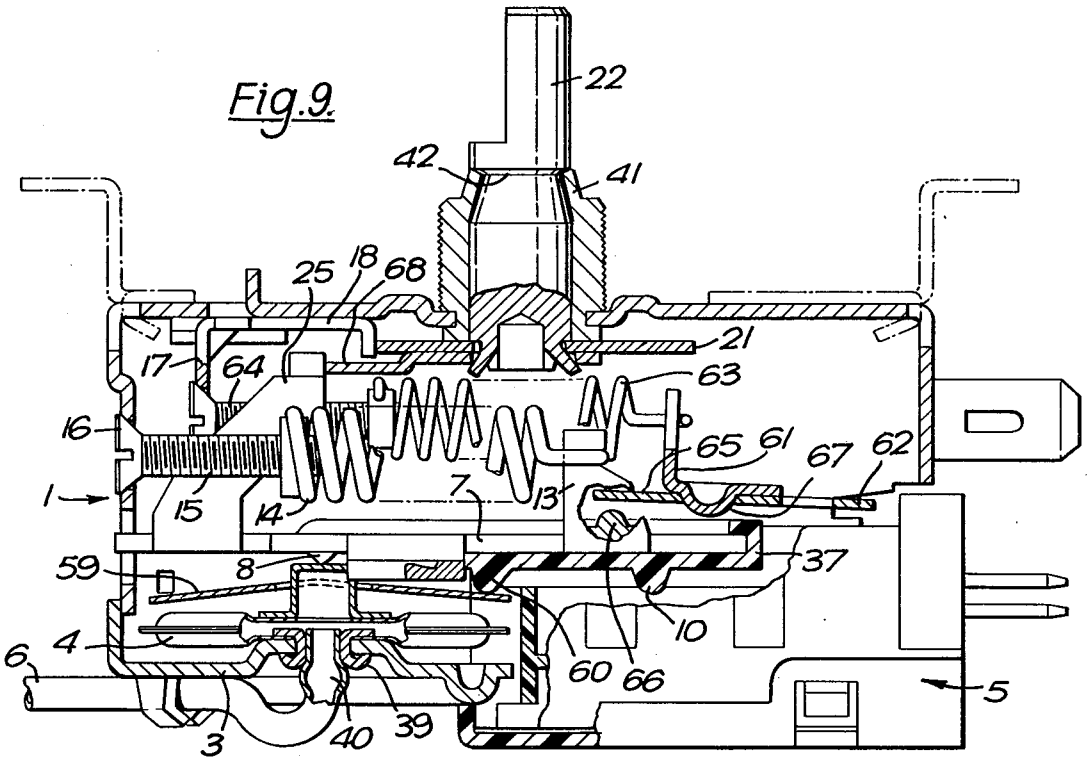
FIG. 9 is a sectional view corresponding to FIG. 1 of a switch unit according to a further embodiment of the invention.

A switch unit according to the present invention can be adapted to meet these requirements, and a modification for this purpose of the switch unit shown in FIG. 1 is illustrated diagrammatically in FIG. 9.

In addition to the components of the switch unit shown in FIG. 1 there is provided a supplementary biasing spring comprising a leaf spring 59 anchored at one end in the frame 2 of the switch housing and acting at its other end on a protuberance 60 provided on the switch operating lever 7 so as to exert on the latter an anti-clockwise (as viewed in FIG. 9) biasing element moment in the same direction as that caused by the biasing spring 14. In this embodiment, however, the anchoring screw 15 for the tension spring 14 is anchored in the aperture 19 in the frame 1 and consequently the tension in the spring 14 is adjustable only by means of the screw 15 and not by means of the cam 21. Consequently, when the pressure in the capsule 4 increases, in response to an increase in the sensed temperature, the point at which the switch is operated by the lever 7 will always be constant, representing the desired "constant cut-in" operating condition. To provide for variation in the "cut-out" temperature a "cut-out" lever 61 of L-shape is pivotally mounted in the frame 2 of the switch housing at 62, the lever 61 being biased in an anti-clockwise direction, as viewed in FIG. 9, by a helical tension spring 63 one end of which is attached to the lever 61 and the other end of which is attached to a screw 64 the head of which is carried by the bracket portion 17 of the cam slider 18. The lever 61 has a projecting arm 65 which cooperates with a fixed stop 66 within the switch housing. In addition the lever 61 has a rounded portion 67 which cooperates with the switch operating lever 7 upon anti-clockwise rotation of the latter, as viewed in FIG. 9, the stop 66 preventing the lever 61 from engaging the lever 7 during clockwise rotation of the latter, that is, during the switch closing or cut-in operation. The stop 66 is so positioned that during the anti-clockwise rotation of the switch operating lever 7, and before the opening of the switch 5 occurs, the lever 7 engages the portion 67 of the lever 61, and thereafter the movement of the lever is resisted by virtue of the tension in the spring 63. Consequently the point at which the switch opens will be determined, at least in part, by the tension in the spring 63 and, therefore, by the angular setting of the cam shaft 22.

The embodiment illustrated in FIG. 9 is similar to that shown in FIG. 1 in having an arrangement for opening the switch contacts, that is, turning the switch off, in one setting of the cam shaft 22. In the FIG. 9 embodiment a further cam 68 is carried on the cam shaft 22 and is engageable with the upstanding appendix 25 carried by the switch operating lever 7 to rock the lever anti-clockwise (as viewed in FIG. 9) and open the switch in an "off" position of the cam shaft 22.

Figure 10:
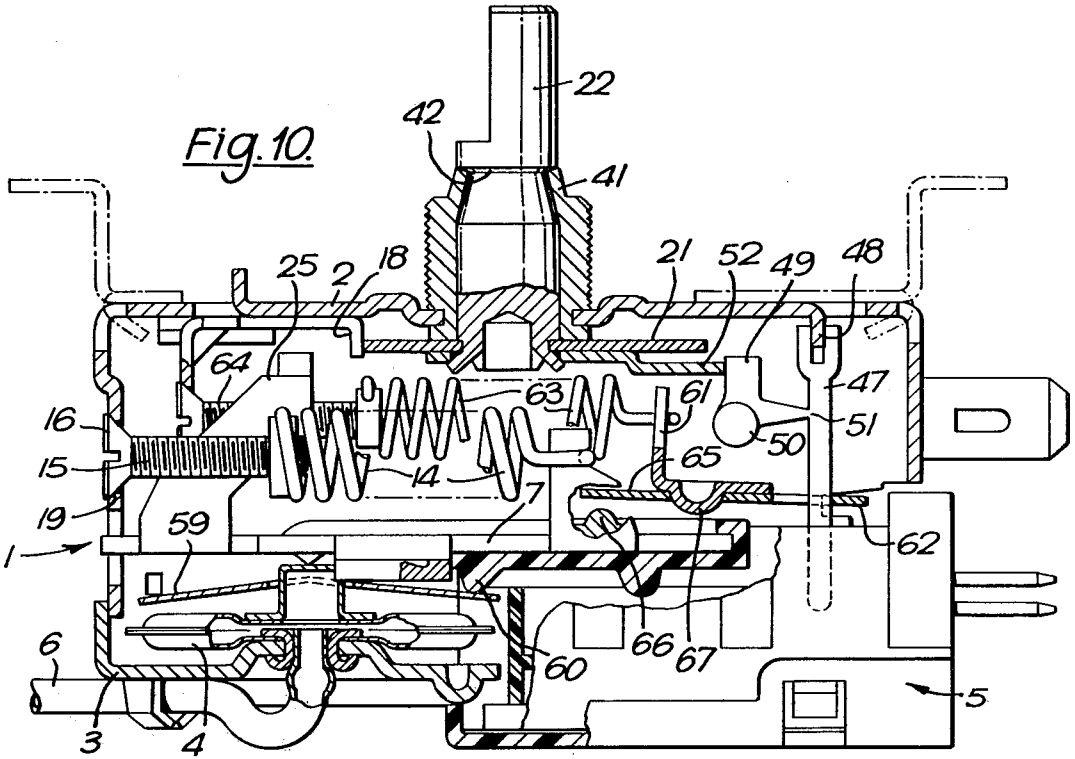
FIG. 10 is a sectional view of a modification of the switch unit shown in FIG. 7.

An alternative switch unit, similar to that of FIG. 9, is shown in FIG. 10, in which a separate "off" switch is provided for operation by an auxiliary cam 52 carried by the cam shaft 22, as described previously with reference to FIGS. 4, 5 and 6. In other respects the switch unit of FIG. 10 is similar to that of FIG. 9.

If it is desired to provide for variation in the "cut-in" or switch on point of the switch unit the helical tension spring 14 in the embodiments illustrated in FIGS. 9 and 10 may be anchored to the cam follower slider 18 in a manner similar to the helical spring 63, as illustrated in FIGS. 1 and 4. Alterntively, the spring 63 may be anchored to the frame 2 of the housing and the spring 14 may be anchored to the cam slider 18, in which case the switch unit will operate in a manner essentially similar to that of FIG. 1, but with a wider temperature (or pressure) differential between the limits of its control cycle.

To avoid undesirable cross-ambient effects it may be necessary to provide a heater for the capsule 4, to maintain the latter at a constant temperature. One form of such a bellows heater is shown in broken outline in FIG. 5 at 69, consisting of a heating resistor connected permanently between the switch terminals 29, 30 in parallel with the switch contacts 31, 32 so that current flows through the heating resistor when the switch contacts are open, the heater being effectively short-circuited when the switch contacts are closed. The heating resistor 69 is located for convenience in the switch assembly 5, but is positioned close to the capsule 4 to achieve the optimum heating effect with a low power heater.

What is claimed is:

1. A control switch unit comprising:

a housing having a housing wall;

a fluid-filled power element mounted within the housing opposite said housing wall;

an operating lever pivotally mounted in the housing and cooperating with the power element;

a switch located in the housing and cooperating with the operating lever to be operated by the power element through the lever, both the power element and the switch being disposed on the same side of the operating lever and on opposite sides of the pivot axis of the lever;

a tension spring located within the housing and acting on the opposite side of the operating lever from the power element and the switch, said tension spring exerting a moment on the lever in opposition to the power element;

cam means acting upon the spring to adjust the tension thereof and to predetermine the operating point of the switch under control of the power element;

a setting shaft connected to the cam means for adjustment of the latter, said setting shaft being rotatable in said housing wall;

said cam means comprising a cam disc located within the hosing and attached to the cam setting shaft, and including a cam slider engaged by the cam disc, said cam slider carrying anchorage means for one end of the tension spring; and, an auxiliary cam mounted on the cam setting shaft, a cam following mechanism operatively associated with the auxiliary cam, and an auxiliary switch within the housing, connected in series with the first switch, and engageable by said cam following mechanism.

2. A switch unit as defined in claim 1, wherein the axis of the setting shaft is perpendicular to the pivot axis of the operating lever.

3. A switch unit as defined in claim 1, wherein the tension spring comprises a helical spring the longitudinal axis of which extends generally parallel to the operating lever, the operating lever having a protuberance to which one end of the spring is anchored, and the unit further including a slider engaging the cam means and movable in the direction of the longitudinal axis of the spring under control of the cam means to adjust the tension in the spring.

4. A switch unit as defined in claim 1, wherein the housing has opposite walls and the operating lever comprises a plate having lugs pivotally supported in said opposite walls of the housing and disposed intermediate the first and second regions of the lever.

5. A switch unit as defined in claim 1 wherein the cam following mechanism cooperating with the auxiliary cam comprises a plunger displaceable longitudinally within the housing and engageable with the auxiliary switch, and a bell-crank lever having a first arm engageable by the auxiliary cam and a second arm having a hinge connection to said plunger.

6. A control switch unit comprising:

a housing having a housing wall;

a fluid-filled power element mounted within the housing opposite said housing wall;

an operating lever pivotally mounted in the housing for rotation about a pivot axis, the lever having a first region which is engaged by the power element;

a switch having an electrically insulating base attached to the housing;

a fixed first switch contact supported by said base;

a snap-action switch blade having anchorage means on the base and projecting cantilever-fashion from said anchorage means in a direction generally parallel to the pivot axis of the operating lever;

a second switch contact carried by the switch blade and cooperating with said first contact, the operating lever having a second region, on the opposite side of the pivot axis of the lever from the first region, engageable with the switch blade to effect snap-movement;

a tension spring located within the housing and acting on the opposite side of the operating lever from the power element and the switch blade, said tension spring exerting a moment on the lever in opposition to the power element;

cam means acting upon the spring to adjust the tension thereof and to predetermine the operating point of the switch under control of the power element; and a setting shaft connected to the cam means for adjustment of the latter, said setting shaft being rotatable in said housing wall.

7. A switch unit as defined in claim 6, including a differential adjustment screw accessible from the outside of the housing for adjustment of the separation of the switch contacts in the open condition of the switch.

8. A switch unit as defined in claim 6, wherein the cam means comprises a cam disc located within the housing and attached to the cam setting shaft, and including a cam slider engaged by the cam disc, said cam slider carrying anchorage means for one end of the tension spring.

9. A switch unit as defined in claim 8, including an auxiliary cam mounted on the cam setting shaft, a cam following mechanism operatively associated with the auxiliary cam, and an auxiliary switch within the housing, connected in series with the first switch, and engageable by said cam following mechanism.

10. A switch unit as defined in claim 9, wherein the cam following mechanism cooperating with the auxiliary cam comprises a plunger displaceable longitudinally within the housing and engageable with the auxiliary switch, and a bell-crank lever having a first arm engageable by the auxiliary cam and a second arm having a hinge connection to said plunger.

11. A switch unit as defined in claim 10, wherein the ball-crank lever and the plunger are formed of plastics material, the hinge connection between the bell-crank lever and the plunger consisting of an integral flexible portion of said plastics material.

12. A switch unit as defined in claim 6, including a resistive heater associated with the power element to heat the latter, said heater being connected electrically in parallel with the switch.

13. A switch unit as defined in claim 6 wherein the axis of the setting shaft is perpendicular to the pivot axis of the operating lever.

14. A switch unit as defined in claim 6 wherein the tension spring comprises a helical spring the longitudinal axis of which extends generally parallel to the operating lever, the operating lever having a protuberance to which one end of the spring is anchored, and the unit further including a slider engaging the cam means and movable in the direction of the longitudinal axis of the spring under control of the cam means to adjust the tension in the spring.

15. A switch unit as defined in claim 6 wherein the housing has opposite walls and the operating lever comprises a plate having lugs pivotally supported in said opposite walls of the housing and disposed intermediate the first and second regions of the lever.

16. A control switch unit comprising:

a housing;

a fluid-filled power element mounted within the housing;

an operating lever pivotally mounted in the housing and cooperating with the power element;

a switch located in the housing and cooperating with the lever to be operated by the power element through the lever, both the power element and the switch being disposed on the same side of the operating lever and on opposite sides of the pivot axis thereof;

a helical tension spring acting upon the operating lever and extending generally parallel to the lever on the opposite side thereof from the power element and the switch;

adjustable anchorage means for the end of the tension spring remote from the operating lever, said adjustable anchorage means being connected to a wall of the housing and being adjustable from the outside of the housing; and pivotal mounting means for the operating lever defining a transverse pivot axis perpendicular to the longitudinal axis of the helical tension spring; a second lever pivotally mounted within the housing and engageable by the switch operating lever in one direction of rocking movement only of the latter; and an adjustable biasing spring acting upon said second lever.

17. A switch unit as defined in claim 16, wherein the biasing spring acting on the second lever has an anchorage at its end remote from the further lever and cam means engageable with said anchorage to adjust the latter and predetermine the force which the second lever exerts on the switch operating lever when engaged by the latter.

18. A control switch unit comprising:

a housing;

a fluid-filled power element mounted within the housing;

an operating lever cooperating with the power element;

pivotal mounting means for the operating lever defining a pivot axis for the lever;

a switch having an electrically insulating base attached to the housing;

a fixed first switch contact supported by said base;

a snap-action switch blade having anchorage means on the base and projecting cantilever-fashion from said anchorage means in a direction generally parallel to the pivot axis of the operating lever;

a second switch contact carried by the switch blade and cooperating with said first contact, the operating lever having a region on the opposite side of the lever pivot axis from the power element which is engageable with the switch blade to effect snap-movement;

a helical tension spring acting upon the operating lever and extending generally parallel to the lever and perpendicular to the pivot axis of the lever, on the opposite side of said lever from the power element and the switch blade; and adjustable anchorage means for the end of the tension spring remote from the operating lever, said adjustable anchorage means being connected to a wall of the housing and being adjustable from the outside of the housing.

19. A control switch unit comprising:

a housing having a housing wall;

a fluid-filled power element mounted within the housing opposite said housing wall;

an operating lever pivotally mounted in the housing and cooperating with the power element;

a switch located in the housing and cooperating with the operating lever to be operated by the power element through the lever, both the power element and the switch being disposed on the same side of the operating lever and on opposite sides of the pivot axis of the lever;

a tension spring located within the housing and acting on the opposite side of the operating lever from the power element and the switch, said tension spring exerting a moment on the lever in opposition to the power element;

cam means acting upon the spring to adjust the tension thereof and to predetermine the operating point of the switch under control of the power element; and a setting shaft connected to the cam means for adjustment of the latter, said setting shaft being rotatable in said housing wall;

said tension spring comprising a helical spring the longitudinal axis of which extends generally parallel to the operating lever, the operating lever having a protuberance to which one end of the spring is anchored;

the unit further including a slider engaging the cam means and movable in the direction of the longitudinal axis of the spring under control of the cam means to adjust the tension in the spring; and, a screw-adjustable anchorage connecting said end of the spring to the cam-operated slider, said adjustable anchorage enabling the tension in the spring to be adjusted independently of the adjustment thereof by the cam means.

* * * * *